US005378216A

United States Patent [19]

Ish, III et al.

[11] Patent Number: 5,378,216

[45] Date of Patent: Jan. 3, 1995

[54] ADJUSTMENT SYSTEM FOR EXERCISE MACHINES

[75] Inventors: A. Buell Ish, III, Renton; John M. Youngsman, Redmond, both of Wash.

[73] Assignee: Vectra Fitness, Inc., Redmond, Wash.

[21] Appl. No.: 98,573

[22] Filed: Jul. 28, 1993

[51] Int. Cl.[6] ..... A63B 21/06

[52] U.S. Cl. ..... 482/94; 482/100; 482/133

[58] Field of Search ..... 482/97-103, 482/133-138, 92-94; 74/577 SF, 142

[56] References Cited

U.S. PATENT DOCUMENTS

| | | | |
|---|---|---|---|
| 156,115 | 10/1874 | Anderson | 74/577 SF |
| 2,854,852 | 10/1958 | Clark | 74/142 X |
| 3,003,359 | 10/1961 | Maasdam | 74/142 X |
| 3,049,338 | 8/1962 | Beebe | 74/142 X |
| 3,881,361 | 5/1975 | Newell | 74/142 X |
| 4,445,669 | 5/1984 | Wilson | 74/142 X |
| 4,763,897 | 8/1988 | Yakata | 482/100 |
| 4,842,271 | 6/1989 | Vinciguerra | 482/100 |
| 5,056,779 | 10/1991 | Webb | 482/100 X |
| 5,102,121 | 4/1992 | Solow et al. | 482/137 X |

*Primary Examiner*—Richard J. Apley
*Assistant Examiner*—John Mulcahy
*Attorney, Agent, or Firm*—Seed and Berry

[57] ABSTRACT

An exercise device, as for example, the wing on a butterfly exercise machine, is arranged to be moved from an at rest position in an exercising direction in a range of travel counter to a load and to be returned to the at rest position by the load. An adjustment mechanism between the exercise device and load selectively adjusts the start of the travel range by movement of the exercise device in a direction opposite from the exercising direction. The adjustment mechanism includes a rack and pawl arranged to be engaged with one another when the exercise device is moved in the exercising direction.

11 Claims, 4 Drawing Sheets

ADJUSTMENT SYSTEM FOR EXERCISE MACHINES

TECHNICAL FIELD

The present invention relates to adjustment systems for exercise machines, and more particularly to an adjustment arrangement for the wings on a butterfly exercise machine.

BACKGROUND OF THE INVENTION

In a standard butterfly exercise station a pair of upstanding padded wings are swing-mounted in elevated positions at opposite sides of a seat for hand and forearm engagement from the back side so that the wings can be swung forwardly by the exerciser in opposition to a weight stack or other load. Usually the load is connected to the wings by a cable system including a cable passing over a sheave and having its ends anchored to respective arched cams so that as the wings are swung forwardly during a butterfly exercise the cams are rotated thereby winding end sections of the cable partway onto the cams and pulling the sheave which is in turn interconnected with the weight stack. Such a system is disclosed in U.S. Pat. No. 4,809,972. In the past minor adjustment of the connection between the ends of the cable and the cams has been provided for by providing cable anchoring fittings on the cams which could be screw-mounted on the cams at selected mounting hole positions. Such an adjustment arrangement is inconvenient to use if the butterfly station is to be used frequently by different people desiring different adjustments.

SUMMARY OF THE INVENTION

The present invention provides an improved adjustment system whereby the starting position of the wings on a butterfly exercise machine can be easily adjusted merely by maneuvering the wings and without requiring the use of a screw driver, wrench, or other tool, or hand-operated lever or pull-pin.

The arched cams on which the loading cable are attached to wind partway over the cams responsive to forward swinging of the wings, contain ratchet plates for pawls which are carried by swing arms on which the wings are mounted. When the pawls engage selected teeth on the ratchet plates the swing arms are held against forward swinging movement relative to the cams so that forward swinging movement of the wings is then resisted by the weight loaded cable which winds on the cams. When the wings are swung rearwardly to an extreme rear position the pawls are released from the ratchet teeth so that the wings can then be swung forwardly until the pawls reach the opposite ends of the ratchet plates where the pawls are guided into engagement again with the ratchet teeth.

DETAILED DESCRIPTION OF THE INVENTION

Figure 1:
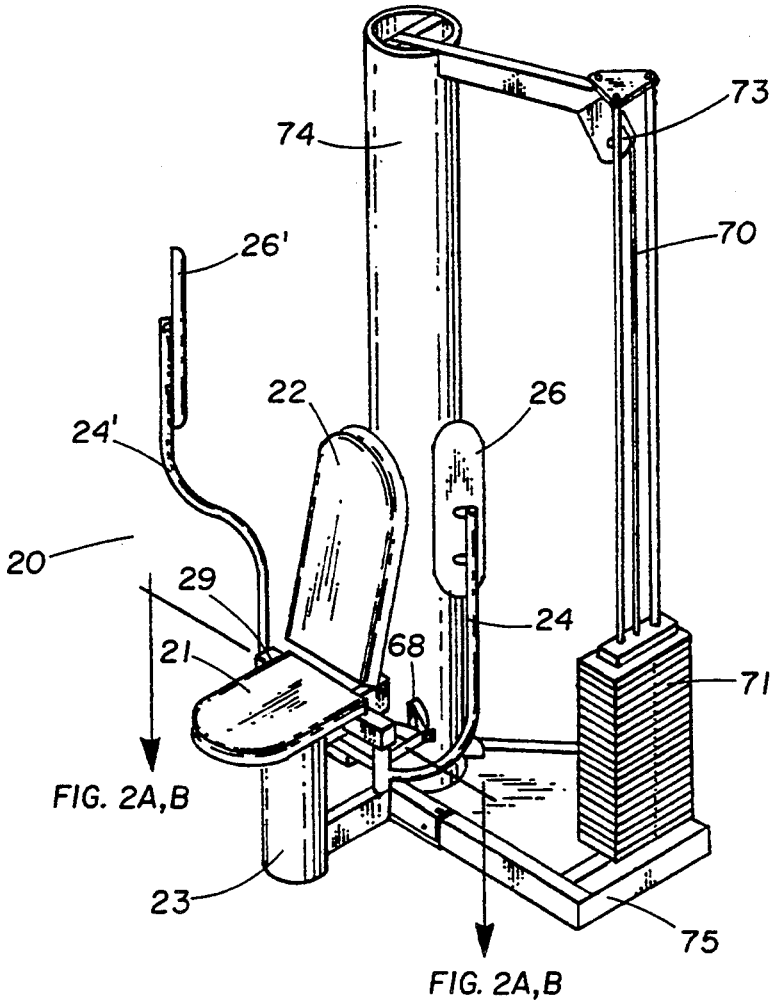
FIG. 1 is a perspective view of a butterfly exercise station having the adjustment system of the present invention.

Referring to the drawings, the invention is shown applied to a butterfly exercise machine 20 having a seat 21 and a back rest 22 mounted on a pedestal 23. The machine has a pair of tubular swing arms 24, 24' at the left and right sides of the seat arranged to swing on vertical axes in response to exercising forces applied to upstanding left and right padded wings 26, 26' mounted on brackets provided at the upper ends of the arms 24, 24'.

During this detailed description of the invention, "right" and "left" will be used with the orientation of a person seated on the seat 21, and parts on the right side corresponding to parts on the left side will be identified by the same reference numerals followed by a prime. In most instances the moving parts on the left and right sides are reversed relative to one another so that when the right wing 26' is swung counter-clockwise from a rear retracted position the left wing 26 can be swung clockwise from a rear retracted position. This will be the swing directions of the wings when the butterfly exercise is performed with the exerciser's arms raised and moved forwardly toward one another from raised side positions while engaging the wings 26, 26' from behind.

Vertical pivots are provided at opposite sides of the machine by a pair of stub shafts 28 projecting downwardly from a horizontal support member 29 which is mounted on the back of the seat pedestal 23. Journaled on these stub shafts are the swing arms 24, 24', and left and right cam units 30, 30' which have respective arcuate cams 31, 31' and ratchet plates 32. Pawls 34 carried by the swing arms cooperate with the ratchet plates.

The left cam unit 30 has its ratchet plate 32 secured to the inner face of its cam 31 and extending from a strap member 36 at one end of the ratchet plate to a position about 40 degrees around the cam 31. The ratchet plate 32 has a hooked entry section **32*a*, a central toothed adjustment section 32*b* with tooth elements 37, and a discharge section 32*c*. At the conclusion of the discharge section 32*c*, there is a gap 38 separating the ratchet plate 32 from a stop 40 which extends below the level of the lower edge of the cam 31**.

The strap member 36 has a slotted cable attachment flange 42 adjacent the entry section **32*a* of the cam plate. At its center the strap member 36 bends in a quarter circle and continues to make connection with the other end of the cam 31. Depending from the curved central portion of the strap member is a bracket 44 on which a bushing housing 45 is mounted. This bushing housing 45 contains a brass bushing receiving the shaft 28 and on a washer 46 retained by a cotter pin 48 extending through the shaft 28. A cover plate 49 is provided for the ratchet plate 32 and leaves an open space 50**.

An elongated bushing housing 52 is mounted on the lower end of the swing arm 24 and has a brass bushing 53 with an enlarged exposed head seated on the bushing housing 45. The swing arm 24 extends horizontally from the bushing housing 52 by a bottom horizontal section, then extends vertically by an intermediate section and outwardly by an upper horizontal section to a top vertical section on which the right wing 26 is mounted. When viewed from above, the bottom and horizontal sections of the swing arm extend at right angles relative to the vertical section therebetween.

Projecting from the bushing housing 52 below the swing arm 24 is a pair of vertically spaced flat bracket arms 54,55 between which a spring holding bar 56 is mounted. This bar 56 projects at an angle of about 20 degrees from the back of the bracket arms 54, 55 and has a spring seat bore 58 near its free end for receiving an end portion of a flexible compression spring 60. The opposite end portion of the spring 60 seats in a bore 61 provided in the tail end of the pawl 34 which is swing-mounted on a pivot pin 62 extending between the bracket arms 54, 55. Swinging of the head end of the pawl 34 away from the ratchet plate 32 is limited by a stop pin 64 projecting from the pawl so as to engage an adjacent edge of the bracket plate 54 as the head of the pawl swings away from the ratchet plate.

Figure 2A:
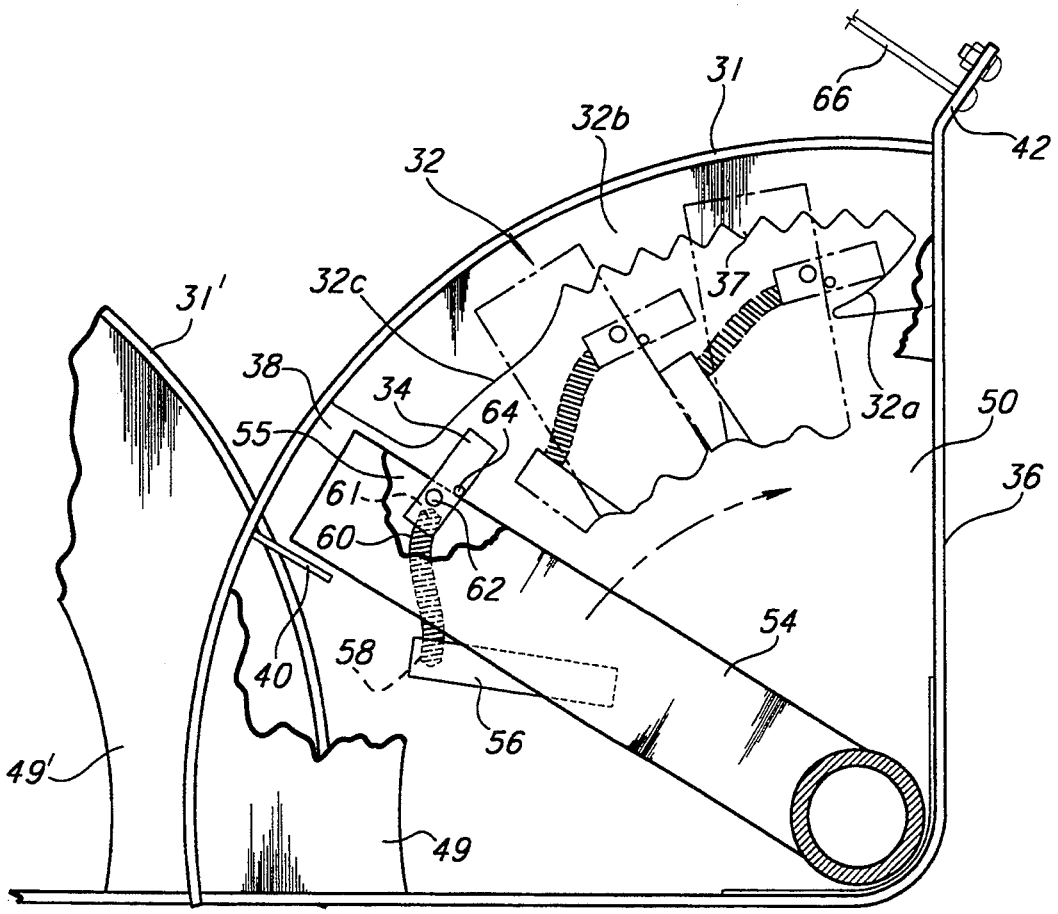
FIGS. 2A and 2B are horizontal sectional views taken as indicated by the lines 2A, B in FIG. 1, and showing several ratchet pawl positions with the pawl disengaged (FIG. 2A) and again engaged (FIG. 2B)
Figure 2B:
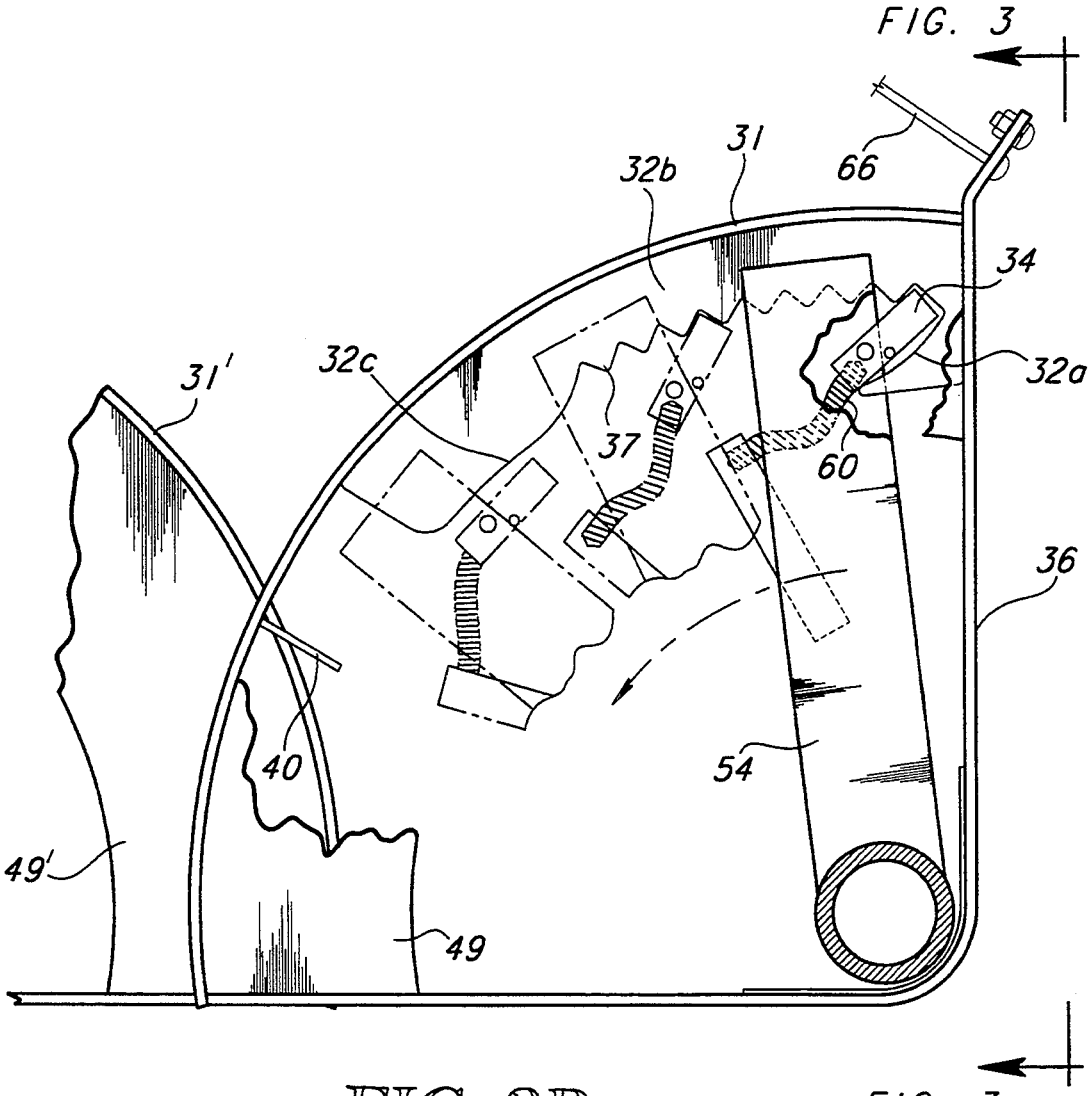
Figure 3:
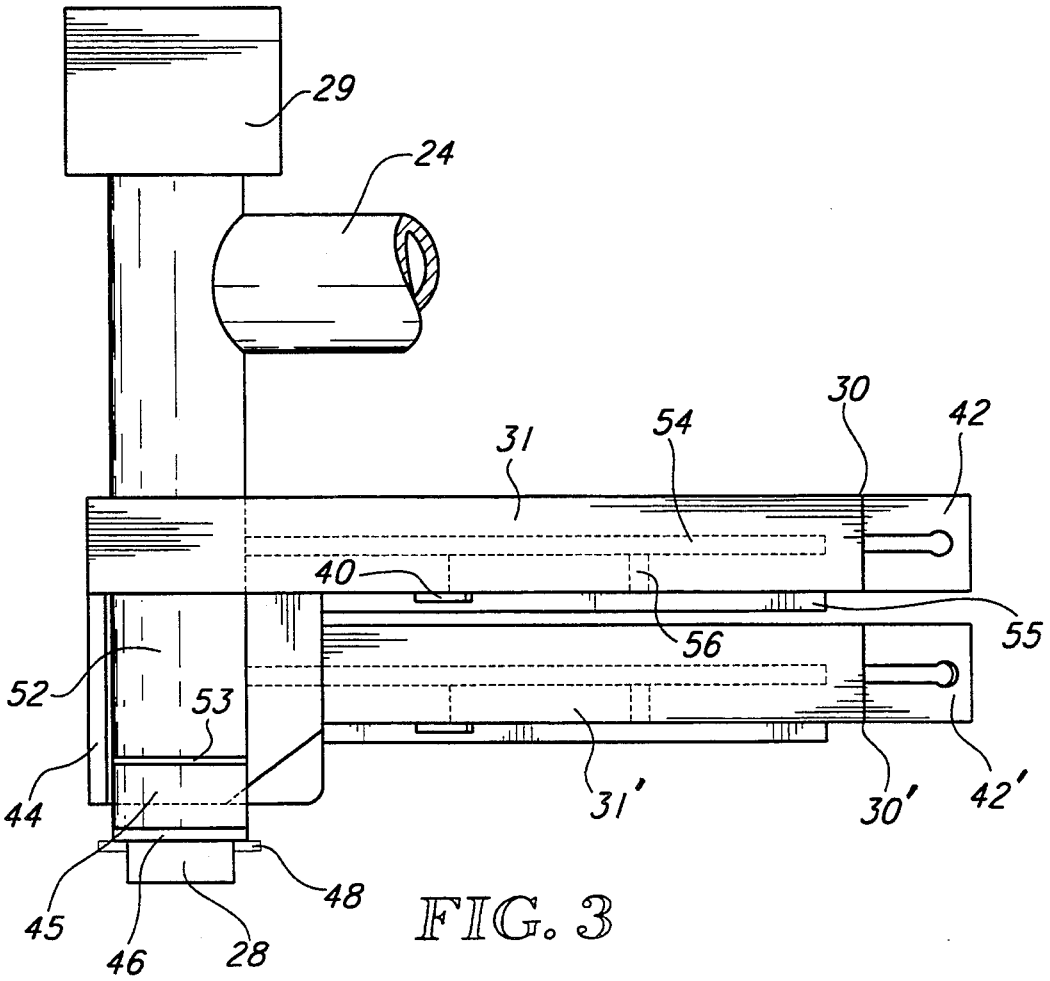
FIG. 3 is an elevational view taken as indicated by line 3—3 in FIG. 2B.

The spring 60 is compressed between the pawl 34 and the bar 56 at all times. Maximum compression occurs at a "center" position in which the bores in the bar 56 and pawl 34 are aligned. When the pawl is swung off-center in a direction moving the head of the pawl toward the teeth 37 on the ratchet plate 32 the spring 60 bows away from the ratchet plate and biases the head of the pawl into an active position in engagement with the teeth 37 (see FIG. 2B). If the pawl is swung past center in the opposite direction the spring 60 bows toward the ratchet plate 32 and biases the head of the pawl away from the ratchet plate into an inactive position (see FIG. 2A). The discharge section **32*c* of the ratchet plate functions as a cam to be engaged by the pawl 34 and cause the pawl to swing from active position to inactive position. When the bracket arms 54, 55 carrying the pawl 34 are swung toward the entry section 32*a* of the ratchet plate the pawl engages the concave cam surface of the entry section as indicated in the far right broken line position in FIG. 2A, and is thereby caused to swing past center to its active position, whereupon further swinging of the bracket arms, by forward swinging of the respective wing 26, causes the head of the pawl to consecutively engage the teeth 37 such as to prevent movement of the bracket arms 54, 55 toward the entry section 32*a*. It is only after the pawl has reached the discharge section and been swung to its inactive position that the bracket arms can be moved toward the entry section of the ratchet plate by rearward swinging of the respective wing 26**.

From the foregoing description it will be understood that when the exerciser desires to adjust the starting position of the wings 26, 26' the exerciser first swings the wings rearwardly until the pawls 34 move into engagement with the entry sections of the ratchet plates. Then the wings are swung forwardly until the pawl engages the entry section and moves into active position resisting further forward movement of the wings. The wings are then swung rearwardly causing the pawl to move from tooth to tooth on the ratchet plates. When the desired starting position for the wings is reached, the rearward swinging of the wings is ceased. The exerciser is then ready to operate the exercise machine in the normal manner.

Figure 4:
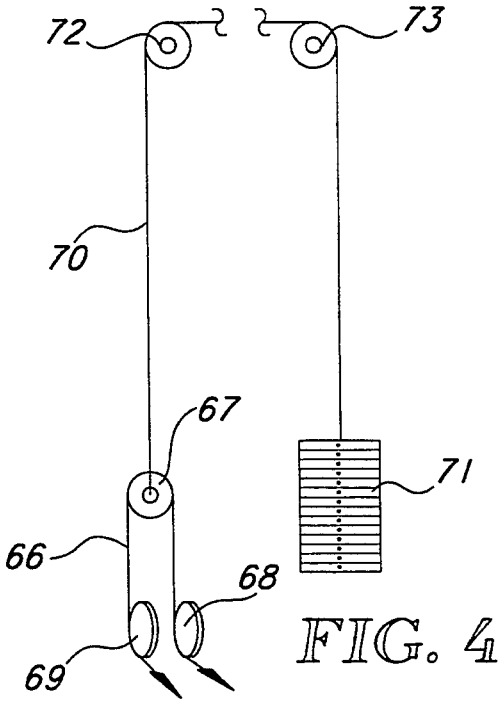
FIG. 4 is a schematic of a typical reeving system between the exercise machine and a weight stack.

As shown schematically in FIG. 4, the ends of a cable 66 have end fittings retained by the slotted flanges 42, 42' at the end of the cams 31, 31'. The cable 66 passes over a floating pulley 67 and downwardly around a pair of guide pulleys 68, 69 to the slotted flanges 42, 42'. The floating pulley 67 is connected by a second cable 70 to a weight stack 71 via upper guide pulleys 72, 73. As shown in FIG. 1, part of the reeving system may be housed in a column 74 on a base frame 75 to which the pedestal 23 may be connected at its lower end. With the described arrangement forward swinging of the wings 26, 26' is resisted by the selected load from the weight stack 71.

From the foregoing it will be appreciated that, although specific embodiments of the invention have been described herein for purposes of illustration, various modifications may be made without deviating from the spirit and scope of the invention. Accordingly, the invention is not limited except as by the appended claims.

We claim:

1. An exercise machine comprising:

a load;

a member arranged to be loaded by said load and providing an activating entry section, a load transfer section with multiple load transfer elements, and an inactivating discharge section, said load transfer section being located between said entry and discharge sections, and said entry and discharge sections being devoid of load transfer elements;

an exercise device;

an adjustment mechanism connected to said exercise device and having an active position and an inactive position, said mechanism being arranged when activated to be moved along a travel range in an adjustment direction from said entry section to said discharge section and successively engage said elements, engagement of said adjustment mechanism with a selected one of said elements resisting movement of said adjustment mechanism responsive to movement of said exercise device in an exercising direction opposite to said adjustment direction unless said adjustment mechanism is in its inactive position, engagement of said mechanism with said discharge section while moving in said adjustment direction causing said mechanism to move from its active position to its inactive position, and engagement of said mechanism with said entry section while moving in said exercising direction causing said mechanism to move from its inactive position to its active position whereat exercising movement of said exercise device is resisted by said load via said adjustment mechanism after said mechanism has then been moved to a selected one of said elements.

2. An exercise machine according to claim 1 in which said load is connected to said member by a cable and sheave system.

3. An exercise machine according to claim 1 in which said member comprises a rack and said elements comprise teeth on said rack, and in which said adjustment mechanism comprises a biased pawl having an active over-center position and an inactive over-center position opposite from said active over-center position, said discharge section being adapted to move said pawl from active position to inactive position, and said entry section being adapted to move said pawl from inactive position to active position.

4. An exercise machine according to claim 3 in which said pawl is biased by a compression spring arranged to arch in opposite directions responsive to movement of said pawl into said over-center positions.

5. An exercise machine according to claim 1 in which said exercise device and said member are arranged to swing about the same axis.

6. An exercise machine according to claim 3 in which said exercise device and said member are arranged to swing about the same axis, and in which said pawl is swing-mounted to swing a limited amount about a swing axis parallel to said same axis.

7. An exercise machine comprising:

a load;

a member arranged to be loaded by said load and providing an activating entry section, a load transfer section with multiple load transfer elements, and an inactivating discharge section;

an exercise devise comprising a seat and butterfly exercise device having a swing arm at one side of said seat;

an adjustment mechanism connected to said swing arm and having an active position and an inactive position, said mechanism being arranged when activated to be moved along a travel range in an adjustment direction from said entry section to said discharge section and successively engage said elements, engagement of said adjustment mechanism with a selected one of said elements resisting movement of said adjustment mechanism responsive to movement of said swing arm in an exercising direction opposite to said adjustment direction unless said adjustment mechanism with said discharge section while moving in said adjustment direction causing said mechanism to move from its active position to its inactive position, and engagement of said mechanism with said entry section while moving in said exercising direction causing said mechanism to move from its inactive position to its active position whereat exercising movement of said swing arm is resisted by said load via said adjustment mechanism after said mechanism has then been moved to a selected one of said elements.

8. An exercise machine according to claim 7 in which said exercise machine comprises opposite hand duplicates of said member and adjustment mechanism and a second swing arm at the side of said seat which is opposite from said one side.

9. An exercise machine according to claim 1 in which said member comprises an arcuate unit connected to a cable which is interconnected with said load, said cable being arranged to wind onto said arcuate unit counter to said load responsive to movement of said exercise device in said exercising direction.

10. An exercise machine according to claim 1 in which said member and exercise device are swing-mounted on a support frame to swing about a vertical swing axis.

11. An exercise machine comprising:

a load;

a member arranged to be loaded by said load and providing an entry section, a discharge section, and a load transfer section with multiple load transfer elements located between said entry and discharge sections, said entry and discharge sections being devoid of load transfer elements;

an exercise device;

an adjustment mechanism connected to said exercise device and having an active position and an inactive position, said mechanism being arranged when activated to be moved along a travel range in an adjustment direction from said entry section to said discharge section and successively engage said elements, engagement of said adjustment mechanism with a selected one of said elements resisting movement of said adjustment mechanism responsive to movement of said exercise device in an exercising direction opposite to said adjustment direction unless said adjustment mechanism is in its inactive position, means at said discharge section for causing said mechanism to move from its active position to its inactive position;

and means at said entry section for causing said mechanism to move from its inactive position to its active position whereat exercising movement of said exercise device is resisted by said load via said adjustment mechanism after said mechanism has then been moved to a selected one of said elements.

* * * * *